US012663235B2

(12) United States Patent
Li et al.

(10) Patent No.: US 12,663,235 B2
(45) Date of Patent: Jun. 23, 2026

(54) ANTI-FREEZE WATER GUN STRUCTURE

(71) Applicant: ZhongShan QingYi Metal Products Enterprise CO., LTD, ZhongShan City (CN)

(72) Inventors: Shulong Li, ZhongShan City (CN); Weizhong Qian, ZhongShan City (CN); Kun Guang Wu, ZhongShan City (CN); Tang Chieh Yu, Taichung City (TW)

(73) Assignee: ZHONGSHAN QINGYI METAL PRODUCTS ENTERPRISE CO., LTD., Zhongshan City (CN)

( * ) Notice: Subject to any disclaimer, the term of this patent is extended or adjusted under 35 U.S.C. 154(b) by 129 days.

(21) Appl. No.: 18/888,655

(22) Filed: Sep. 18, 2024

(65) Prior Publication Data

US 2025/0321075 A1 Oct. 16, 2025

(30) Foreign Application Priority Data

Apr. 15, 2024 (CN) ..... 202410448116.5

(51) Int. Cl.
*F41B 9/00* (2006.01)

(52) U.S. Cl.
CPC ..... *F41B 9/0078* (2013.01); *F41B 9/0053* (2013.01); *F41B 9/0071* (2013.01)

(58) Field of Classification Search
CPC ..... F41B 9/0078; F41B 9/0053; F41B 9/0071
See application file for complete search history.

(56) References Cited

U.S. PATENT DOCUMENTS 6,260,774 B1 * 7/2001 Erickson ..... B05B 12/0022 239/526
8,424,781 B2 * 4/2013 Rosko ..... B05B 1/3013 239/528
10,213,800 B2 * 2/2019 Chen ..... B05B 12/002
2014/0263745 A1 * 9/2014 Chen ..... B05B 12/002 239/393
2015/0343467 A1 * 12/2015 Chen ..... B05B 9/01 239/526
2025/0229277 A1 * 7/2025 Chen ..... B05B 12/002

FOREIGN PATENT DOCUMENTS

TW M293796 U 7/2006

* cited by examiner

*Primary Examiner* — Jeremy Carroll
(74) *Attorney, Agent, or Firm* — MUNCY, GEISSLER, OLDS & LOWE, P.C.

(57) ABSTRACT

An anti-freeze water gun structure has a gun body. The gun body has a water passageway therein, a water inlet at a lower end thereof, and a water chamber between the water passageway and the water inlet. A guide tube is provided in the water chamber. A slidable piston is fitted onto the guide tube. A lower end of the guide tube has a sealing structure for blocking a lower end of the water chamber. A lower half of the water chamber, located below the piston, is surrounded by the piston, an inner wall of the water chamber, an outer wall of the guide tube and the sealing structure to form a closed chamber. An elastic member is provided in the closed chamber for elastically pushing the piston upward. A water channel communicating with the water inlet and the water passageway is formed in the guide tube.

10 Claims, 4 Drawing Sheets

ANTI-FREEZE WATER GUN STRUCTURE

FIELD OF THE INVENTION

The present invention relates to a water gun, and more particularly, to an anti-freeze water gun structure.

BACKGROUND OF THE INVENTION

When water turns into ice, its volume increases by one-tenth. For a conventional water gun, when the water remaining in the water gun turns into ice, the gun body may break or the internal components may be damaged.

There are some anti-freeze water guns developed on the market. Taiwan Utility Model Publication No. M293796 discloses an anti-cracking structure of a water spray gun. When the water freezes, the volume expansion force pushes the piston towards the chamber, so that part of the water flows out from the perforation, eliminating the pressure of expansion on the gun body. After the ice melts, the return spring pushes the piston back to restore the original spraying function of the water gun.

However, such a water gun still has the following shortcomings:

1. The spring in the gun body is immersed in water, which will cause corrosion on the surface of the spring after a period of time, especially in water with impurities or in corrosive water, the spring may break down soon. In addition, over time, corrosion may appear on the surface of the spring, which in turn affects the elasticity and mechanical property of the spring, thus impairing the normal function of the water gun.
2. At lower temperatures, the water in the gun will freeze, which not only generate expansion pressure in the space around the spring but also directly freeze the spring itself. As a result, the spring cannot function normally. In this case, even a water gun having an anti-freeze structure may not work due to spring failure, reducing the reliability of the water gun in low-temperature environments.
3. The spring cannot be removed and replaced, making it difficult to maintain the spring. When the spring is damaged or needs cleaning or when the user wants to replace a different spring, it is difficult to disassemble and replace the spring.
4. The anti-freeze structure is integrated with the parts, such as the nozzle and the switch, resulting in poor adaptability. That is, the nozzle and the switch must be customized and designed according to the anti-freeze structure. They are only suitable for rear-pressure gun bodies and cannot be used for other types of water guns. In addition, due to the highly dependent design of the anti-freeze structure with respect to the nozzle and the switch, any modification or replacement of these core components needs to take into account the complex interactions between them. This not only restricts users from using other brands or models of accessories for replacement or upgrade but also brings inconvenience to the repair and maintenance of the water gun. When the water gun is damaged or its performance deteriorates, it is difficult to find suitable accessories, or it is necessary to purchase a new water gun, rather than replacing the damaged part.

Accordingly, the inventor of the present invention has devoted himself based on his many years of practical experiences to solve these problems.

SUMMARY OF THE INVENTION

In view of the deficiencies of the prior art, the primary object of the present invention is to provide an anti-freeze water gun structure with a simple structure, durability and long service life.

In order to achieve the foregoing object, the anti-freeze water gun structure provided by the present invention comprises a gun body, a switch unit for turning on/off a water flow, and a nozzle unit for adjusting a water spray. The gun body has a water passageway therein and a water inlet at a lower end thereof. The gun body further has a water chamber between a lower end of the water passageway and the water inlet. A guide tube is provided in the water chamber. A piston able to slide up and down is fitted onto the guide tube. A lower end of the guide tube has a sealing structure for blocking a lower end of the water chamber. A lower half of the water chamber, located below the piston, is surrounded by the piston, an inner wall of the water chamber, an outer wall of the guide tube and the scaling structure to form a closed chamber. An elastic member is provided in the closed chamber for elastically pushing the piston upward. A water channel communicating with the water inlet and the water passageway is formed in the guide tube.

Preferably, the switch unit and the nozzle unit are disposed on a top of the gun body, and the water chamber is disposed in a grip of the gun body, so that the guide tube, the piston and the elastic member in the water chamber are independent of the switch unit and the nozzle unit.

Preferably, the guide tube is detachably connected to the gun body, and the elastic member is detachably fitted onto the guide tube.

Preferably, the sealing structure includes a sealing boss on the lower end of the guide tube, and the sealing boss is threadedly connected to the lower end of the water chamber.

Preferably, a water inlet connector is detachably connected to the water inlet for connecting a water tube. An upper end of the water inlet connector communicates with the water channel of the guide tube.

Preferably, the sealing structure further includes a sealing gasket between the water inlet connector and the sealing boss.

Preferably, the water inlet connector is threadedly connected to the water inlet.

Preferably, a center of an underside of the sealing boss has a screw groove for receiving a screwdriver or screwdriver bit.

Preferably, an upper end of the water chamber has an annular restricting step for restricting upward movement of the piston.

Preferably, the piston is equipped with a plurality of sealing rings. The sealing rings are in close contact with the inner wall of the water chamber or the outer wall of the guide tube.

Embodiments of the present invention will now be described, by way of example only, with reference to the accompanying drawings.

DETAILED DESCRIPTION OF THE PREFERRED EMBODIMENTS

Figure 1:
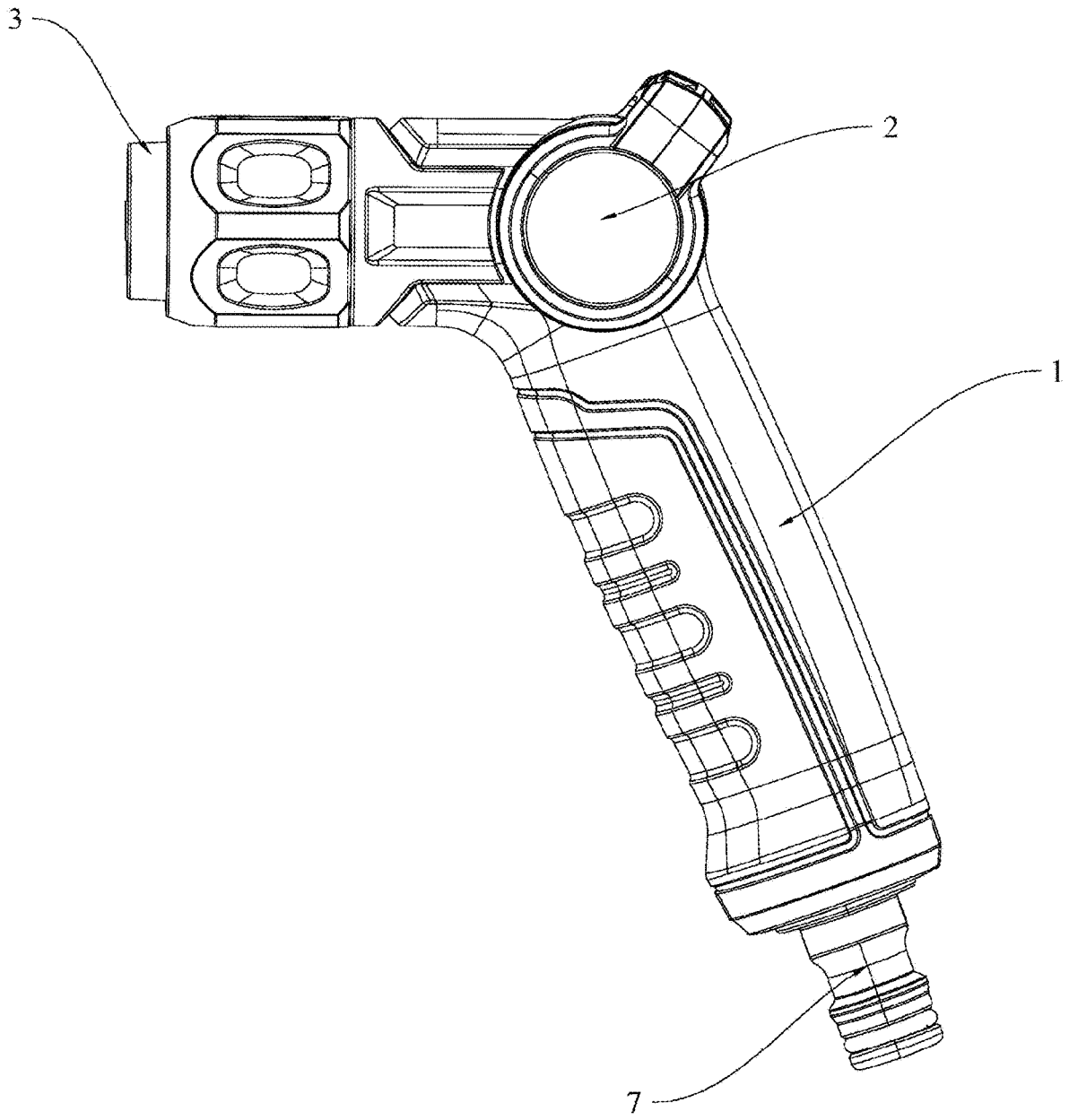
FIG. 1 is a planar view of the present invention.
Figure 2:
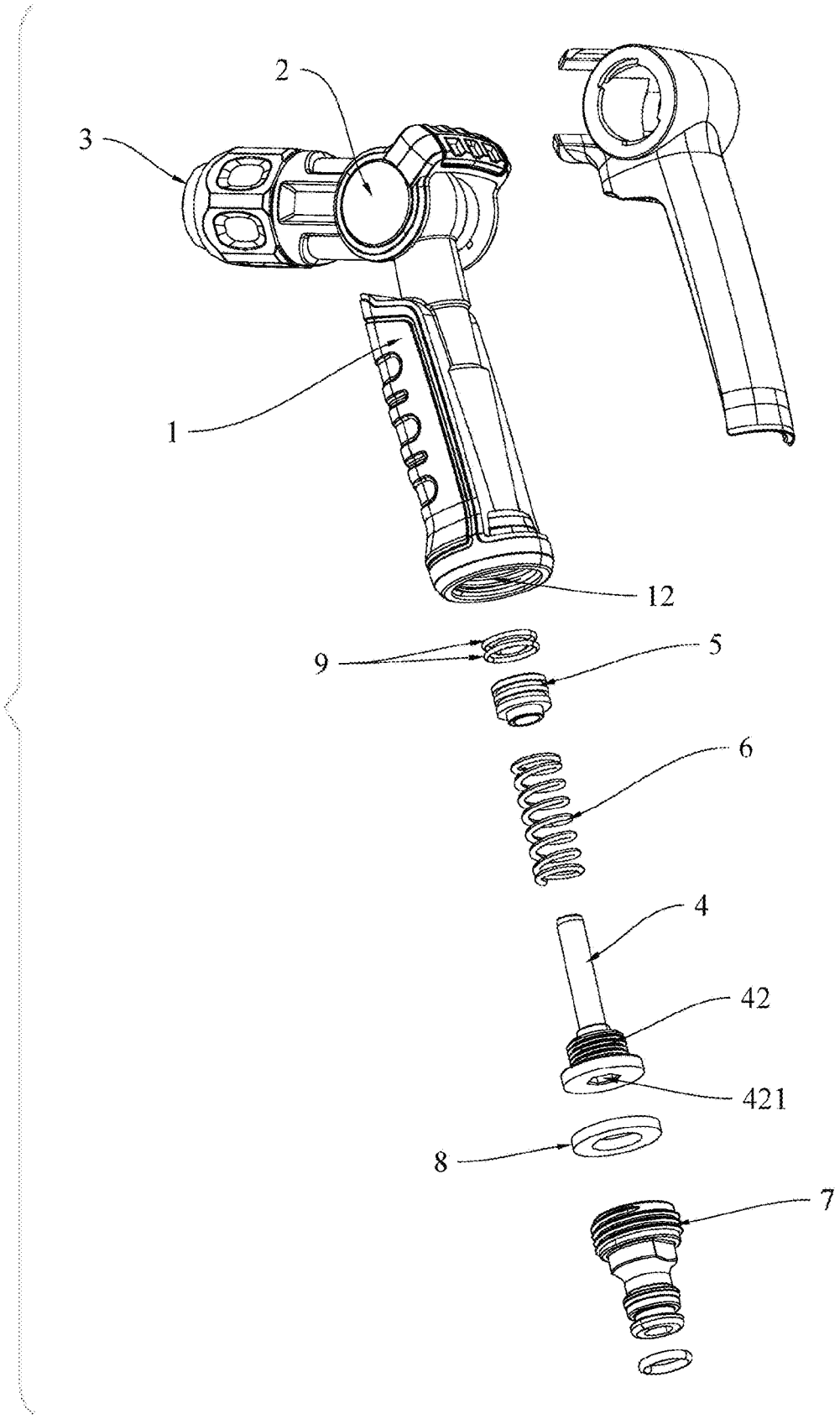
FIG. 2 is an exploded view of the present invention.
Figure 3:
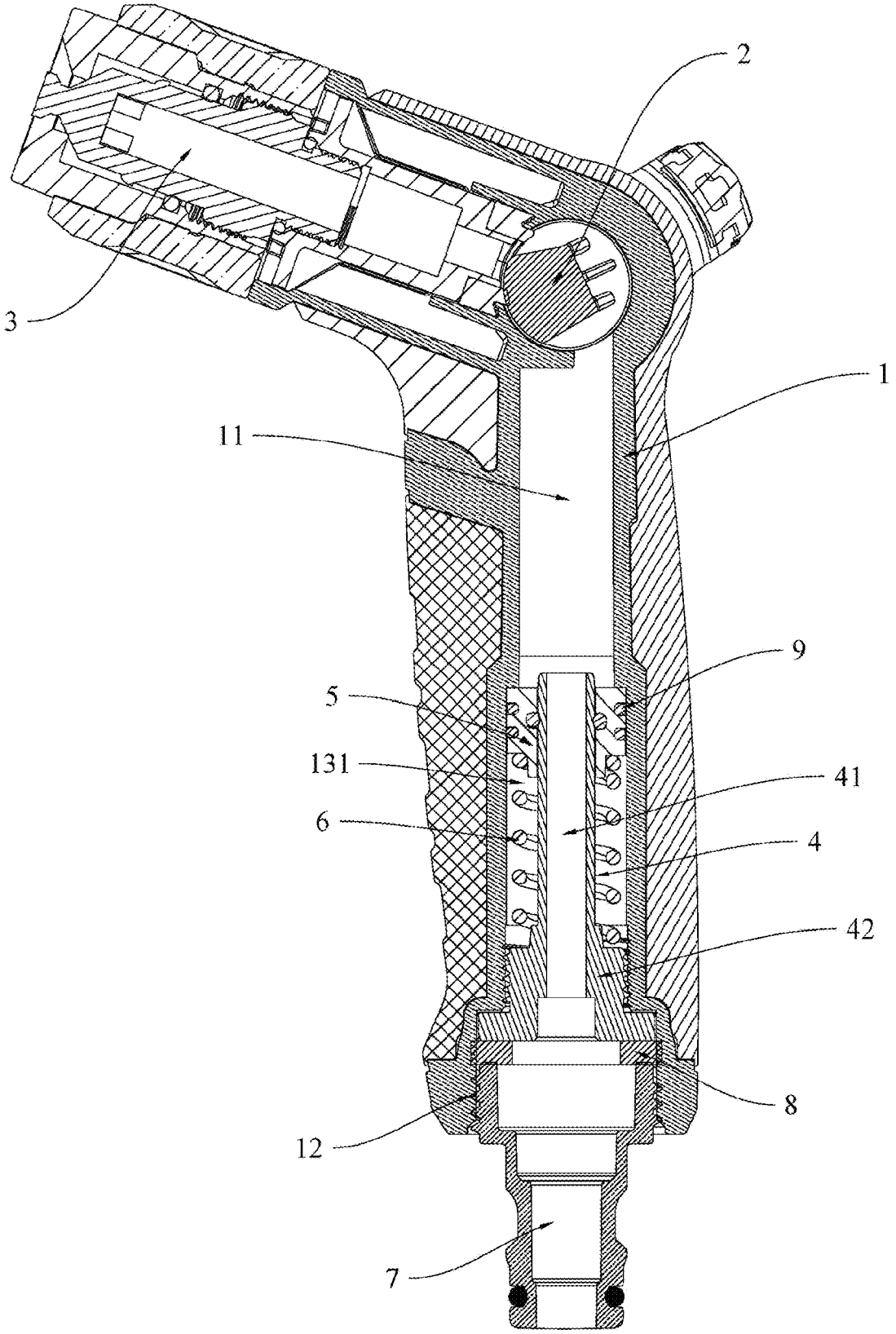
FIG. 3 is a cross-sectional view of the present invention.
Figure 4:
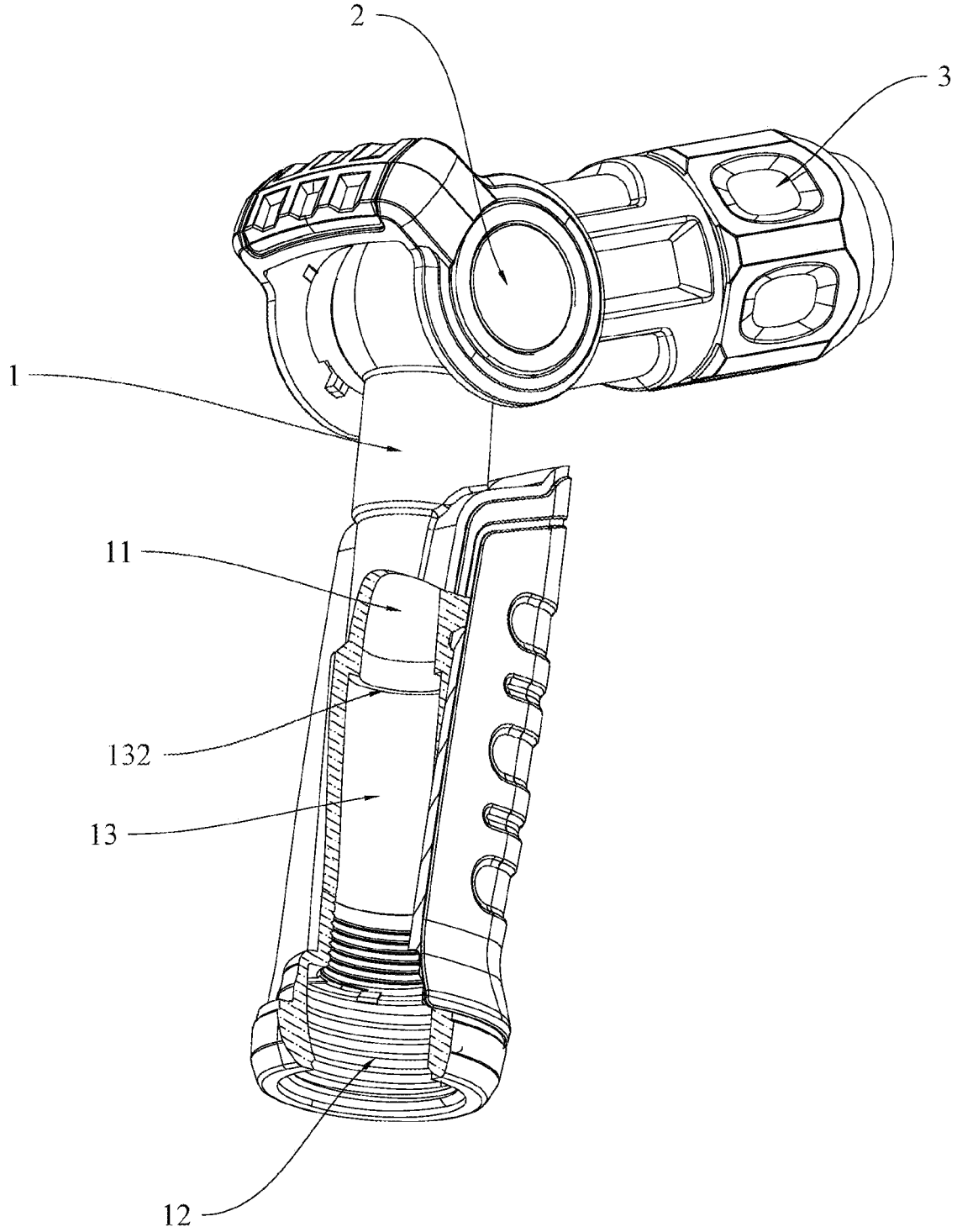
FIG. 4 is a perspective, partial sectional view of the present invention.

As shown in FIG. 1 through FIG. 4, the present invention discloses an anti-freeze water gun structure, comprising a gun body 1, a switch unit 2 for turning on/off a water flow, and a nozzle unit 3 for adjusting a water spray. The gun body 1 has a water passageway 11 therein and a water inlet 12 at a lower end thereof. The water passageway 11 in the gun body 1 is the main path of the water flow. The water flow enters the gun body 1 via the water inlet 12, and is controlled by the switch unit 2, and finally sprays out from the nozzle unit 3. This process ensures the basic function of the water gun, namely, spraying water.

The gun body 1 further has a water chamber 13 between the lower end of the water passageway 11 and the water inlet 12. A guide tube 4 is provided in the water chamber 13. A piston 5 able to slide up and down is fitted onto the guide tube 4. The upper half of the water chamber 13, located above the piston 5, communicates with the water passageway 11. The guide tube 4 in the water chamber 13 cooperates with the sliding of the piston 5 to form a structure capable of dynamically adjusting the size of the space. When the temperature decreases and the water volume expands due to freezing, the piston 5 is pushed downward to increase the space above the piston 5, thus relieving the internal pressure caused by the expansion of ice.

The lower end of the guide tube 4 has a sealing structure for blocking the lower end of the water chamber 13. The lower half of the water chamber 13, located below the piston 5, is surrounded by the piston 5, the inner wall of the water chamber 13, the outer wall of the guide tube 4 and the sealing structure to form an annular closed chamber 131. An elastic member 6 is provided in the closed chamber 131 for elastically pushing the piston 5 upward. A water channel 41 communicating with the water inlet 12 and the water passageway 11 is formed in the guide tube 4.

Preferably, the elastic member 6 is a spring.

In normal use, the water flow enters the water gun via the water inlet 12, passes through the water channel 41 and the water passageway 11, and finally sprays out from the nozzle unit 3. The switch unit 2 on the water passageway 11 is used for controlling the flow of water.

In cold environments, the water remaining in the water gun freezes and causes the volume to expand. When the water freezes, the volume expansion force pushes the piston 5 downward, increasing the volume of the upper portion of the water chamber 13 above the piston 5, thereby eliminating the expansion pressure on the gun body. When the ice melts, the elastic member 6 pushes the piston 5 back, restoring the original spray function of the water gun. This design can realize an anti-freeze function.

The more important innovation of the present invention is that the elastic member 6 is located in the closed chamber 131 and is not in contact with water, so the elastic member 6 is well protected. Because the elastic member 6 is located in a closed environment and does not come into direct contact with water, it will not be damaged by freezing expansion or water corrosion, improving the durability and service life of the water gun greatly.

More specifically, the switch unit 2 and the nozzle unit 3 are disposed on the top of the gun body 1. The water chamber 13 is disposed in a grip of the gun body 1 so that the components (the guide tube 4, the piston 5, and the elastic member 6) in the water chamber 13 are independent of the switch unit 2 and the nozzle unit 3.

The most notable feature of the present invention is the independence of the anti-freeze mechanism. The anti-freeze mechanism, that is, the arrangement of core components such as the guide tube 4, the piston 5, and the elastic member 6, does not depend on the structure of the switch unit 2 and the nozzle unit 3. This independence means that, first, even if the switch unit or the nozzle unit malfunctions or needs to be replaced, the normal operation of the anti-freeze mechanism will not be affected, ensuring the reliability and durability of the water gun in harsh environments; secondly, because the anti-freeze mechanism is independent of other components such as the switch unit and the nozzle unit, this design may be easily adapted to different types of gun bodies, whether they are front- or rear-pressure bodies. This versatile design expands the application of the product greatly, enabling the anti-freeze water gun to meet the needs of different users.

More specifically, the guide tube 4 is detachably connected to the gun body 1, and the elastic member 6 is detachably fitted onto the guide tube 4. This structure allows the guide tube 4 and the elastic member 6 (a spring) to be separated from the gun body 1 easily.

Preferably, the detachable structure between the guide tube 4 and the gun body 1 is that the lower end of the guide tube 4 has a sealing boss 42, and the sealing boss 42 is threadedly connected to the lower end of the water chamber 13, thereby realizing the detachable connection of the guide tube 4 and the gun body 1.

In addition, the design of the elastic member 6 also takes into account the convenience of the user. It can be directly fitted onto the guide tube 4 and is removable. Users can disassemble and reassemble the components to meet their different needs easily, such as the need to replace the elastic member 6 that has failed due to wear and tear, or to adjust the anti-freeze capability according to a specific use environment. Users may choose elastic members 6 with different elasticity according to specific needs, thereby ensuring the anti-freeze effect while meeting different cost control requirements. This detachable design improves the flexibility and maintainability of the water gun greatly, which not only makes maintenance and replacement of parts easier and more economical but also provides users with customized solutions to adapt to different use scenarios and needs.

As mentioned above, in order to form the closed chamber 131 for protecting the elastic member 6, the lower end of the guide tube 4 is designed with a sealing structure capable of blocking the lower end of the water chamber 13. The sealing structure includes the sealing boss 42 on the lower end of the guide tube 4. The sealing boss 42 is threadedly connected to the lower end of the water chamber 13. This threaded connection not only ensures a tight and stable connection but also facilitates the user's operation when maintenance or replacement of the parts are required.

More specifically, the sealing structure further includes a sealing gasket 8 between a water inlet connector 7 (described in detail below) and the sealing boss 42 to further enhance the sealing effect.

More specifically, the water inlet connector 7 is detachably connected to the water inlet 12 and is configured for connecting a water tube (not shown in the figure). The upper end of the water inlet connector 7 communicates with the water channel 41 of the guide tube 4, thereby realizing a smooth connection between the water source and the interior of the water gun.

More specifically, the detachable connection structure is that the water inlet connector 7 is threadedly connected to the water inlet 12. This detachable connection structure not only facilitates installation and maintenance but also increases the flexibility and applicability of the overall structure.

When the internal components of the water gun need maintenance or replacement, it is necessary to pay attention to the disassembly sequence between the water inlet connector 7 and the guide tube 4. Since the water inlet connector 7 blocks the guide tube 4 from below, the water inlet connector 7 must be disassembled before removing the guide tube 4. This sequence is beneficial to protect the components from being damaged while ensuring a smooth disassembly process.

More specifically, in order to further facilitate the disassembly and maintenance of the guide tube 4, the center of the underside of the sealing boss 42 has a screw groove 421, such as a hexagonal groove. This design allows the use of tools such as screwdrivers or screwdriver bits, which simplifies the disassembly process and facilitates users to maintain or replace parts quickly, thereby improving the maintenance efficiency and user experience of the water gun greatly.

More specifically, in order to control the movement of the piston 5, the upper end of the water chamber 13 has an annular restricting step 132 for restricting upward movement of the piston 5. This design not only protects the internal structure from damage caused by excessive movement but also ensures the stability and reliability of the water gun when in use.

More specifically, the piston 5 is equipped with a plurality of sealing rings 9. The sealing rings 9 are in close contact with the inner wall of the water chamber 13 or the outer wall of the guide tube 4. This design increases the sealing effect between the piston 5 and the surrounding walls greatly, preventing water leakage and thus improving the sealing performance and efficiency of the overall structure.

The invention claimed is:

1. An anti-freeze water gun structure, characterized in that the anti-freeze water gun structure comprises a gun body, a switch unit for turning on/off a water flow, and a nozzle unit for adjusting a water spray; the gun body has a water passageway therein and a water inlet at a lower end thereof, the gun body further has a water chamber between a lower end of the water passageway and the water inlet, a guide tube is provided in the water chamber, a piston able to slide up and down is fitted onto the guide tube, a lower end of the guide tube has a sealing structure for blocking a lower end of the water chamber, a lower half of the water chamber, located below the piston, is surrounded by the piston, an inner wall of the water chamber, an outer wall of the guide tube and the sealing structure to form a closed chamber, an elastic member is provided in the closed chamber for elastically pushing the piston upward, and a water channel communicating with the water inlet and the water passageway is formed in the guide tube.

2. The anti-freeze water gun structure as claimed in claim 1, wherein the switch unit and the nozzle unit are disposed on a top of the gun body, and the water chamber is disposed in a grip of the gun body, so that the guide tube, the piston and the elastic member in the water chamber are independent of the switch unit and the nozzle unit.

3. The anti-freeze water gun structure as claimed in claim 1, wherein the guide tube is detachably connected to the gun body, and the elastic member is detachably fitted onto the guide tube.

4. The anti-freeze water gun structure as claimed in claim 3, wherein the sealing structure includes a sealing boss on the lower end of the guide tube, and the sealing boss is threadedly connected to the lower end of the water chamber.

5. The anti-freeze water gun structure as claimed in claim 4, wherein a water inlet connector is detachably connected to the water inlet for connecting a water tube, and an upper end of the water inlet connector communicates with the water channel of the guide tube.

6. The anti-freeze water gun structure as claimed in claim 5, wherein the sealing structure further includes a sealing gasket between the water inlet connector and the sealing boss.

7. The anti-freeze water gun structure as claimed in claim 5, wherein the water inlet connector is threadedly connected to the water inlet.

8. The anti-freeze water gun structure as claimed in claim 4, wherein a center of an underside of the sealing boss has a screw groove for receiving a screwdriver or screwdriver bit.

9. The anti-freeze water gun structure as claimed in claim 1, wherein an upper end of the water chamber has an annular restricting step for restricting upward movement of the piston.

10. The anti-freeze water gun structure as claimed in claim 1, wherein the piston is equipped with a plurality of sealing rings, and the sealing rings are in close contact with the inner wall of the water chamber or the outer wall of the guide tube.

* * * * *